United States Patent [19]

Phipps, Sr. et al.

[11] Patent Number: 4,680,947

[45] Date of Patent: Jul. 21, 1987

[54] INTERCHANGEABLE KNITTING NEEDLE SYSTEM

[75] Inventors: Cornelius M. Phipps, Sr.; Cornelius M. Phipps, Jr., both of Glen Ellyn, Ill.

[73] Assignee: Plastic Specialties, Inc., Glen Ellyn, Ill.

[21] Appl. No.: 879,206

[22] Filed: Jun. 26, 1986

Related U.S. Application Data

[63] Continuation-in-part of Ser. No. 736,867, May 22, 1985, abandoned.

[51] Int. Cl.[4] ..... D04B 35/02

[52] U.S. Cl. ..... 66/117

[58] Field of Search ..... 66/117, 118

[56] References Cited

U.S. PATENT DOCUMENTS

| | | | |
|---|---|---|---|
| 1,999,691 | 4/1935 | Graham | 66/117 |
| 2,309,528 | 1/1943 | Otting et al. | 66/117 |
| 2,633,720 | 4/1953 | Robbins | 66/117 |
| 2,693,095 | 11/1954 | Slingsby | 66/117 |
| 3,280,595 | 10/1966 | Linstead | 66/117 |
| 4,007,610 | 2/1977 | Linstead | 66/117 |
| 4,494,387 | 1/1985 | Phipps et al. | 66/117 |

FOREIGN PATENT DOCUMENTS

| | | | |
|---|---|---|---|
| 3445241 | 7/1985 | Fed. Rep. of Germany | 66/117 |

*Primary Examiner*—Ronald Feldbaum
*Attorney, Agent, or Firm*—Lee, Smith & Zickert

[57] ABSTRACT

An improved interchangeable knitting needle system comprising knitting needles, preferably made of molded plastic, and being formed with cable connecting members that prevent breakage of the needles during use with detachably engaged hollow flexible cables that collect the knitted loops, and the like therealong. A pair of needles may be connected to opposite ends of a flexible cable for the storage of looped yarn therebetween. The system further includes a double-ended connector member capable of interconnecting a plurality of flexible cables between a pair of knitting needles. Said double-ended connector member having opposite connecting ends which are also detachably engageable at the ends of the joined flexible cables. The system further provides a stop button capable of detachably connecting to one end of a cable whereby one knitting needle may be independent of the cable, and another knitting needle may be secured to the other end of the cable to enable the storage of looped yarn along the cable. Said system components being interchangeably connectible to flexible cables without requiring cable adaptors between the cable and breakable plastic connector portions whereby to provide for easy rearrangement of the components and minimize breakage.

25 Claims, 12 Drawing Figures

INTERCHANGEABLE KNITTING NEEDLE SYSTEM

RELATED APPLICATION

This application is a continuation-in-part of our copending application Ser. No. 736,867, filed May 22, 1985 and now abandoned.

BACKGROUND AND SUMMARY OF THE INVENTION

The invention relates to an improvement for knitting needle systems of the type in which various components are interchangeable whereby the hand knitting of a variety of projects may be accomplished.

Interchangeable knitting systems have been provided in the past, but suffer from various faults including breakage of the end connecting portion of the knitting needles. This is usually the result of the increased moment caused by a metal tube adaptor acting like a lever arm while being affixed to the connector end of the needle at one side, and to the yarn cable at the other. For example, in our U.S. Pat. No. 4,494,387, which issued Jan. 22, 1985, a preferably metal tube or cable adaptor is utilized for plastic interchangeable knitting needles. For the sake of economy and ease of handling, it is desirable that the knitting needles comprise a plastic material. As a result, the integral connector which extends from the bottom of the needle is necessarily made of plastic and threaded in order to be capable of engagement with the tube adaptor. While the invention disclosed in our patent is quite useful with regard to the interchangeability of components, the breakage problem experienced at the connector end has rendered this system less effective.

It is therefore the specific goal of the present invention to overcome the breakage problems caused at the connector end of the knitting needles by the elimination of adaptors interconnecting the cable and the knitting needle in one form of the invention. The invention specifically solves this breakage problem in this first form of the invention by the direct engagement of a novel knitting needle connector end to the cable.

As provided in our said U.S. Pat. No. 4,494,387, the present invention also provides a stop button when only one knitting needle is required to be connected to a cable for the storage of looped yarn. Additionally, the present invention provides double-ended connectors for stringing a series of cables between knitting needles so that increased yarn storage capacity is achieved. In the first form of the invention both the stop button and double-ended connector members have connecting end portions of substantially the identical construction to that of the knitting needles. Thereby, a simple standard connecting procedure is used for all the components enabling the system to be quickly re-arranged while greatly reducing breakage of the connector ends.

In a second from of the invention, it is an object to eliminate plastic connector ends extending from the knitting needles and alternately provide an integrally molded metal insert male coupling member which is thread engageable with a female connecting member having, at an opposite end, an engageable coupling stem for attachment to hollow flexible cables. The female connecting member is quickly thread-disengageable from the male coupling member whereby a concomitant goal of providing for interchangeability of cables and system components is achieved.

In furtherance of the objectives of the second form of the invention, double-ended connector members, having cable attachment means similar to the female member are intended to be alternately usable from those of the first form of the invention whereby to string cables together. Likewise, it is an objective of the second form of the invention to provide an alternately usable stop button means having a cable-connecting means substantially the same as that of the female connecting member when it is desirable to use only one knitting needle at one end of the cable with a stop button means, rather than a second needle, at the other.

Additionally, it is an objective of the second form of the invention to optionally provide a resilient O-ring between the base, or end face, of the knitting needle and a barrel portion of the female connector whereby a tight engagement, with a smooth exterior surface, is provided that allows for the male/female engaged threading to be relatively loose and permit the craftsperson to control the compressive tightness of the coupling between the male coupling member and the female connector member.

There is also provided, in all forms of the invention, the capability of utilizing cables of varying wall thicknesses whereby pull strength can be increased. The heavy duty cables useful in the system are formed to allow a smooth sliding movement of looped yarn from the barrel of the needle onto the cable member.

The first form of the invention may briefly be summarized as comprising knitting needles having a conical tip formed in a conventional manner with a barrel or shaft portion that is the hand-holding portion of the needle. Opposite the conical tip, the barrel terminates in either a beveled or non-beveled end portion whereby to have an end, or base, diameter substanially the same as the diameter of a cable when the cable is engaged to the needle. The engagement of the cable to the needle is performed by an improved connecting end that includes a stem which is partially threaded and has an outside diameter somewhat larger than the internal diameter of the cable. Inasmuch as the needles preferably comprise plastic, injection molding is best suited to form the needles. The sprue portion of each of the molded needles is left partially intact at the tip of the threaded stem and provides a guiding prong, or tip, facilitating easy insertion of the threaded portion interiorly of the cable. The threaded stem self-taps into the wall of the cable for a secure but removable connection. The cable may have a similarly described needle at the opposite end whereby knots of yarn may be gathered therebetween. Otherwise, one needle may be left as a free member and the other connected to a cable having a stop button engaged at the distal end thereof. Thereby, the looped yarn may be gathered along the cable and prevented from sliding off of the cable upon abutting the stop button. The stop button is provided with a substantially identical threaded connector end for self-tapping engagement into the cable. When a large-sized knitting project is undertaken, a plurality of cables may be interconnected in between knitting needles, or in between a knitting needle and a stop button, by the provision of a double-ended connector member. The connector member has oppositely extending self-tapping threaded end connectors for engagement with the cables in like fashion to the connecting ends of the knitting needles and the stop button. By virtue of the elimination of tube adaptors between the cable and knitting needle, stop button, or connectors, the moment, or leverage, at the base of the threaded end connector is greatly reduced whereby breakage is substantially eliminated. Moreover, the first form of the improved inventive knitting needle system also eliminates the need for providing specially formed resilient locking means for the connector ends which were provided for the engagement of the tube adaptors described in our said U.S. Pat. No. 4,494,387.

In the second form, the invention may be briefly summarized as comprising a knitting needle similar to that of the first form, but wherein the end, or base, of the needle, rather than having an extending connecting portion formed integrally of the same material as the rest of the needle, is alternately provided with an integrally molded metal male coupling member in a permanent affixation therewith. Additionally, in this second form of the invention, a female connecting member is thread engageable with an extending threaded stem portion of the male coupling member at a threaded bore of a barrel portion thereof. At the opposite end, the female member has a roughened extending stem which friction fits interiorly at the ends of a hollow, flexible cable. Thus, a metal-to-metal connector assembly is provided that eliminates the breakage problem found in the prior art.

In the second form, the two-member connector assembly may include a flexible O-ring arranged between the base or end face of the knitting needle and the thread-engaged barrel portion of the female connecting member. Thereby, a compressive force against the O-ring is created as the female connector is thread-engaged to the male coupling member, whereby the connecting tightness may be controlled by the craftsperson. Additionally, the use of an O-ring provides a smooth transition for yarn loops passing from the knitting needle over the coupling assembly and also compensates for any mismatching at the end diameter of the knitting needle and female connector. Similar to the first embodiment of the invention, the second embodiment provides for a double-ended connector having a roughened engageable friction fit portion at both sides of a central barrel portion, similar to the extending stem of the female connector, whereby flexible cables may be strung together. Likewise, a stop-button means may be provided to have an extending stem similar to that of the female connector extending stem whereby to be engageable at the opposite end of a cable when the craftsperson utilizes only one knitting needle at the other end of the cable, or string of cables. In all forms of the invention, however, the utilization of the stop-button and double-ended connector of the first form of the invention may be utilized inasmuch as these components attach only to the ends of flexible cables, not directly to the knitting needles, and are thus not utlized for the interconnection of the knitting needle to a flexible cable.

DESCRIPTION OF EXAMPLE BEST EMBODYING THE INVENTION

With reference to FIGS. 1–9, it will be understood that in a first form the invention comprises an interchangeable knitting needle system and components therefor which include in preferred form: a plurality of knitting needles, having substantially identical connector end means; one or more hollow flexible cables for connecting the needles together; a stop button; and, a double-ended connector, wherein the knitting needles, stop button and double-ended connector all have substantially the same cable-connecting end means and are capable of engaging the cables in a like manner.

Figure 1:
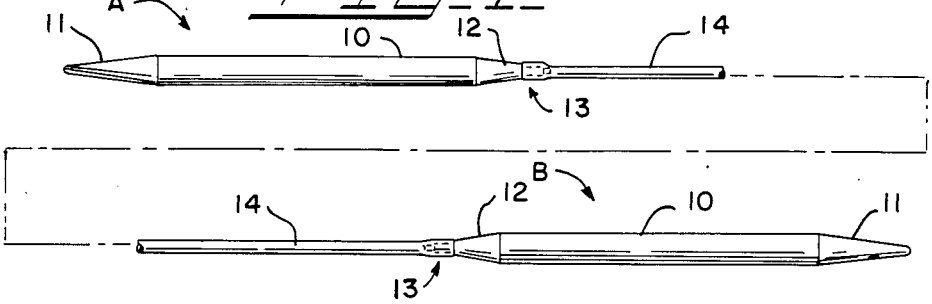
FIG. 1 is a plan view of two substantially identical knitting needles in the preferred embodiment of the first form of the invention, wherein the needles are directly engaged at opposite ends of a flexible cable, shown in dashed lines, by means of connector ends formed at the base of the needles.

With particular reference made to FIG. 1, a pair of substantially identical knitting needles A and B are shown, each having a shaft, or holding, portion 10 suitable to be grasped by the craftsperson. The yarn-knitting function is made possible by conically-shaped tips 11 at one end of the shaft 10, and formed in a conventional manner for the creation of yarn loops, or knots. Adjacent the base of the needles, opposite the tips 11, the shafts 10 include beveled portions 12 having a generally truncated cone configuration.

The beveled sections 12 terminate at the end of the needle whereat threaded connector ends 13 axially extend from a flat base 15 for the engagement with a flexible cable 14. The flexible cable 14 is shown in broken lines indicating the connection therebetween with the needles A and B for the storage of accumulated knots of yarn.

The first form of the invention is best characterized by the elimination of adaptors, or other means, between the knitting needle and cable. The threaded connector ends 13 are provided to self-tap into the hollow cable 14 and also may be disengaged therefrom for future reengagement, as will be explained hereinafter. Thus, needles A and B are fully removable and interchangeable with cable 14.

Figure 6:
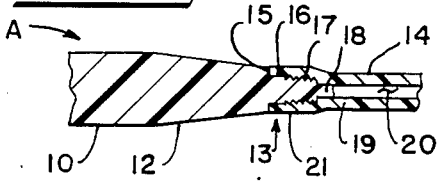
FIG. 6 is a cross-sectional view of the connection of the knitting needle and cable as shown in FIG. 1.

With reference now made to FIG. 6, the engagement between the knitting needle A and cable 14 is explained. It will be understood that a like engagement would be obtained at the identical knitting needle B engaged at the opposite end of the cable 14.

Knitting needle A has a length of about 4.00 inches and the diameter of the shaft portion 10 is from about 0.170 inches to about 0.260 inches. The beveled portions 12 are beveled at about 15° whereby to create at the flat end, or base, 15 a diameter of about 0.150 inches. As will be understood, this base diameter matches the enlarged, of flared end, diameter of the cable 14 upon being thread engaged with the connector end 13. The connector end 13 comprises a partially nonthreaded shank portion 16 and a threaded portion 17. The outside diameter of threaded portion 17 is, in preferred form, about 0.099 inches. The manufacture of the knitting needles A and B is envisioned as being provided by an injection molding process wherein the plastic material preferably used is a Type 6 nylon, ABS, or equivalent. As a result, a sprue tip 18 is formed by the molding procedure, which is left intact to extend outwardly of the threaded portion 17. The threads for threaded portion 17 are cut after the molding is accomplished in a known manner. This sprue tip 18 serves as an alignment, or insertion, means to aid in the engagement of the threaded end 13 interiorly of the cable 14.

Cable 14 is a tubular member, formed in the exemplary embodiment of PVC plastic, and has an outer wall 19 and an open passage 20 extending for the full length of the cable. In preferred form, cable 14 has an outside diameter of about 0.125 inches and an internal diameter at passage 20 of approximately one-half of the outside diameter, i.e., 0.062 inches. Thereby, the wall 19 has a thickness of about 0.032 inches.

The attachment of the needle A to the cable 14 is accomplished by first inserting tip 18 interiorly of passage 20. Thereafter, the threaded portion 17 self-taps into the wall 19 by the user rotating the shaft portion 10. At full engagement, the flat base 15 abuts the end of the cable 14. Because the threads 17 have a larger outside diameter than the diameter of tube 20, cable 14 is caused to flare at 21. With the given dimensions for this embodiment, the diameter of the flared portion 21 is approximately 0.150 inches, equaling the diameter of the base 15. As a result, a smooth transition is achieved as looped yarn slides from the shaft 10, across the bevel 12, over the cable interface at base 15, and then downwardly to be stored along the cable 14.

Figure 5:
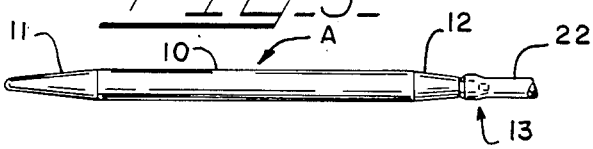
FIG. 5 is a plan view of a knitting needle as shown in FIG. 1, but connected to cable having a thicker wall dimension then as shown in FIG. 1, wherein the cable is provided with an end bevel for a smooth transition from the knitting needle.

With reference now made to FIG. 5, a cable 22 is shown which consists of a thicker-walled member than that shown for the cable 14, whereby to attain a greater pull strength when required in a particular knitting project. In like manner to the engagement with the cable 14, needle A similarly self-taps at connector end 13 interiorly of the cable 22, as best viewed in conjunction with FIG. 7.

Figure 7:
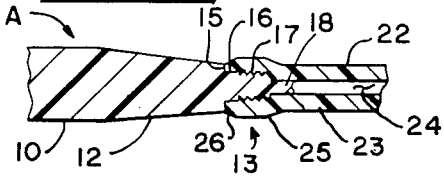
FIG. 7 is a cross-sectional view of the connection between the knitting needle and the thicker cable as shown in FIG. 5.

The cross-sectional view illustrated in FIG. 7 shows that the larger-wall cable 22 includes a wall section 23 of a greater thickness than the wall 19 for the cable 14. In the illustrated embodiment, the cable 22 provides an outside diameter of 0.150 inches, and the wall 23 surrounds a passage 24 to provide an internal diameter substantially the same as the tube portion 20. The thickness of wall 23 is thus increased to about 0.044 inches, or slightly greater than 33% thicker than the wall 19 thickness. In like fashion, the connector end 13 self-taps interiorly of the passage 25 whereby to flare the cable 22 at 25. Inasmuch as the cable 22 is thicker than the cable 14, the outside diameter of the flared portion 25 exceeds the diameter of the base 15 of the knitting needle A. To provide for a smooth transition from the needle A onto the cable 22, the cable 22 is provided with circumferential end bevel 26 whereby to reduce the diameter from the enlarged portion 25 to about 0.150 inches in order to be substantially the same as the diameter of the base 15. A circumferental end bevel for such heavier duty cables is envisioned for use in all forms of the invention.

Figure 2:
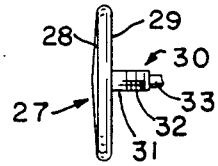
FIG. 2 is a side view of a stop button which may be interchanged with one of the knitting needles shown in FIG. 1.
Figure 3:
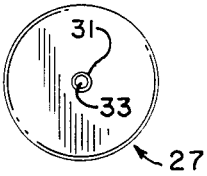
FIG. 3 is a front view of the stop button as shown in FIG. 2.

With reference now made to FIGS. 2 and 3, a stop button 27 is disclosed in the preferred embodiment for the first form of the invention and is similarly formed by the preferred manner of injection molding used for the needles A and B. The material for the stop button 27 is also preferably Type 6 nylon, ABS, or equivalent. The stop button 27 comprises a disk-portion 28 that is formed with a flat face 29 at one side thereof. A central connecting end 30 is formed to extend axially from the disk-shaped portion 28 and includes a smooth shank portion 21 and an outwardly extending threaded portion 32. The injection molding process again creates a sprue tip at 33 in similar manner to tips 18 for needles A and B. The configuration for the connecting end 30 is substantially identical to that of the connector end 13 of the needles. Accordingly, the threaded portion 32 has an outside diameter which is the same as the outside diameter of the threaded portion 17. The stop button 27 therefore may be interchanged with one of the needles A or B as shown in FIG. 1, wherein the craftsperson may utilize one free needle, while the other is engaged to the cable 14 having the stop button 27 connected at the remote cable end.

The interchange between the needle A or B with the stop button 27, is simply accomplished by unthreading the connector end 13 from the cable and engaging the connecting end 30 of the stop button 27 interiorly of the cable 14 or 22.

Figure 4:
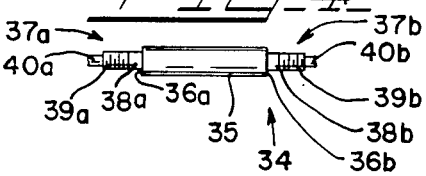
FIG. 4 is a plan view of a double-ended connector in accordance with the invention which is capable of stringing a plurality of flexible cables together by means of connecting ends arranged at opposite ends thereof for direct engagement with cables at either side of the doubleended connector.

Certain knitting projects may require the storage of a large amount of looped yarn. As a result, the invention additionally provides for the stringing of a plurality of cables either to extend between a pair of knitting needles, or to depend from a single needle and terminate at an engaged stop button 27. For this purpose, a double-ended connector member 34 is provided in the first form of the invention. With reference to FIG. 4, it will be seen that the double-ended connector member 34, in the preferred embodiment, provides a central solid shaft 35 having, at opposite ends thereof, flat faces **36*a* and 36*b*. The diameter of the shaft 35 will be understood to be substantially the same as the diameter of the base 15 for needles A and B in order to substantially match the diameter of the flared ends of the cables upon engagement. Thereby, the smooth transition from one cable to the next is achieved. The engagement with two oppositely extending cables is accomplished by the provision of oppositely directed connector ends 37***a* and 37*b*. The connector ends 37*a* and 37*b* again will be understood to be substantially the same as the connector ends 13 of the needles, and connecting end 30 for the stop button 27. Connector ends 37*a* and 37*b* have, respectively, non-threaded shank portions 38*a* and 38*b* which are integrally formed with outwardly extending threaded portions 37*a* and 39*b*. The threaded portions 39*a* and 39*b* terminate in sprue tips 40*a* and 40*b* to likewise provide an aid in engaging the connector 34 with cable 14 or 22. Similar to the engagement between the connector end 13 of the knitting needles A and B, the ends of cable 14 would flare, or enlarge, to about 0.150 inches. When the cable has a thicker wall, such as shown for the cable 22, the bevel 26 provided at the end of the cable provides for the smooth transition across the double-ended connector 34 as would be understood by one skilled in the art.

A simple engagement or disengagement of the double-ended connector 34 is achieved by the self-tapping threaded portions 39*a* and 39*b*. Thus, double-ended connector 34 may be quickly connected or disconnected from a cable to increase or decrease the number of cables extending between two knitting needles, or between a knitting needle and a stop button 27. The utilization of the double-ended connector 34 and stop button 27, at the ends of flexible cables as disclosed for the first form of the invention, are functional, and may be provided, in all forms of the invention.

While it is possible to provide cables of varying lengths so that the connector member 34 might not be required, it is envisioned that for ease of manufacture and packaging, a plurality of cables in the range of about 12 to 21 inches long will be provided so that the individual may choose a specific length, and may also string two or three of the cables together to achieve a variety of cable lengths.

Figure 8:
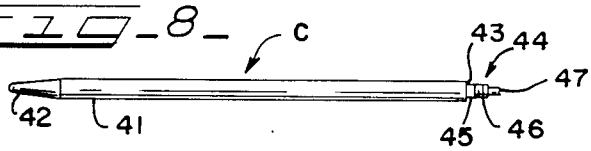
FIG. 8 is a plan view of another embodiment for the knitting needle having a smaller shaft diameter and a non-beveled end, also suitable for use with the flexible cables shown in FIGS. 5 and 7.
Figure 9:
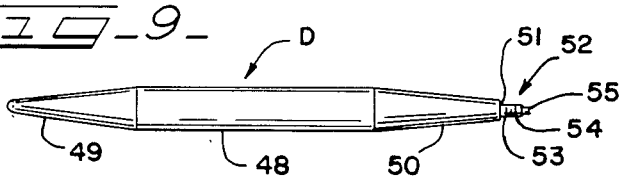
FIG. 9 is a large-sized knitting needle having a central shaft diameter substantially larger than the knitting needle shown in FIGS. 5 and 8, and providing a beveled transition portion suitable for use with the flexible cables shown in FIGS. 5 and 7.

FIGS. 8 and 9 illustrate two additional embodiments of the first form of the invention for knitting needles at a thin knitting needle C in FIG. 8, and a thick knitting needle D in FIG. 9, such as might used for "loose knit" projects.

The knitting needle C provides a shank portion 41 which is grasped by the user. At one end, a conical tip 42 is provided for the knotting of yarn. Extending from the conical end 42, the shaft 41 provides no bevel, but is smooth and simply terminates at flat base 43. In this embodiment, the diameter of the shaft 41 is about 0.150 inches whereby to substantially equal the diameter of the flared end portion 21 of the cable 14, as shown in FIG. 6. The needle C includes a connector end 44 formed in the same configuration as the connector ends 13 for needles A and B. The connector end 44 provides a smooth shank 45 that is integrally formed with a threaded portion 46 which has an outside diameter substantially the same as that of the threaded portion 17 of connector end 13. A sprue tip 47 is again left generally intact after molding to aid in the centering and insertion of the needle 41 interiorly of the cable passage 20 or 24. When the self-tapping engagement with the cable 14 is made, the enlarged, or flared, portion 21 is again formed, as illustrated in FIG. 6. The diameter of the enlarged portion 21 is approximately 0.150 inches in the exemplary embodiment of the cable 14. As stated, the 0.150 inch diameter of the shaft 41 matches this flared cable size and therefore no beveled end for the needle C is required.

The knitting needle D includes a central shaft portion 48 having a relatively large diameter of about 0.400 inches. At one end of the needle D, a conical tip 49 is provided. Opposite the conical tip 49, a bevel 50, having about a 12° angle, transitions the diameter of the shaft 48 to a flat base 51 having the stated diameter for the exemplary embodiment for the first form of the invention of about 0.150 inches. Bevel 50 creates the same cable interface relationship as is shown in FIGS. 6 and 7 with respect to base 15 of the needle A and cables 14 or 22. A connector end 52 extends outwardly from the base 51 and includes a smooth shank portion 53 integrally formed with a threaded portion 54. A sprue tip 55 extends outwardly from the threaded portion 54, in similar manner as explained above, whereby to facilitate the guiding of the connector end 52 into engagement with a flexible cable. In the exemplary embodiment of the first form of the invention, the length of the needle D is slightly greater than needles A, B and C. The needles A, B and C are shown as having a length of about 4.00 inches. The needle D has a length of about 4.50 inches, as is common in the industry for large-shank needles.

By the provision of the direct connection between the components to the flexible cables in the first form of the invention, the moment, or leverage, created at the connector ends of the needles A, B, C and D, or at the connecting end of the stop button 27, or at the connector end of the double-ended connector 34, is substantially less than with prior art interchangeable knitting systems. In the past, separate tube or cable adaptors were required to be specially engaged with the sprue-like connecting ends of the needles and the components at one side, while engaged in a different manner to the cable at the other side of the adaptor. The adaptor in those cases undesirably acted like the arm of a lever and would easily snap-off the sprue-like connector end of the needle, stop button, or double-ended connector. The first form of the present invention provides for a relatively flexible, but secure, direct interconnection between specially formed connector ends of the needles and the cables whereby the occurrence of breakage at the connector ends is greatly reduced. Additionally, in the first, and in all forms, the invention provides for the accommodation of relatively thick-walled cables for increased pull strength when needed in particular knitting projects.

While the preferred embodiment for the first form of the invention discloses cables of certain inside and outside diameters for use with the particularly sized and shaped knitting needles A, B, C or D, it will be understood that a wide variety of cables and needle configurations may be utilized. The characterizing feature in the first form of the invention of a commonly-shaped connecting end portion provided for all components makes possible a simple interchangeability of the components as disclosed or their equivalents.

Figure 10:
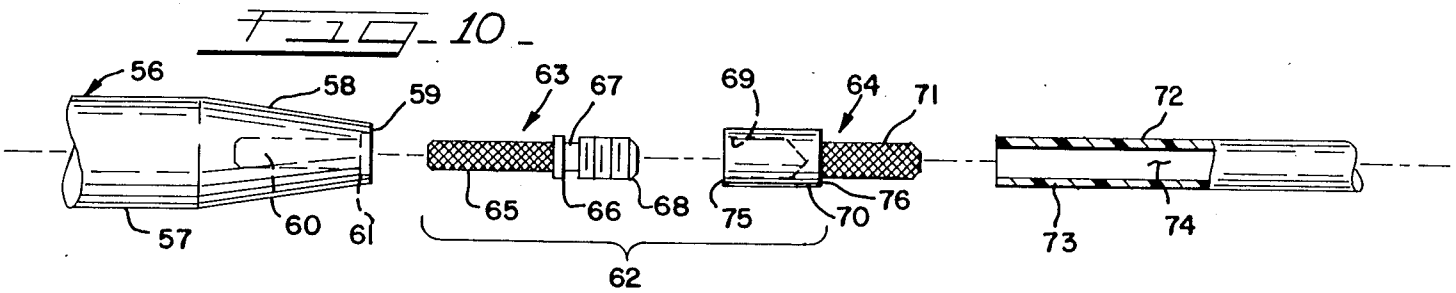
FIG. 10 is an exploded plan view of the preferred embodiment for the second form of the invention showing a detachable two-member metal connector assembly for joining the knitting needle to a cable wherein a first, or male, member of the connector assembly is provided to be integrally formed with the knitting needle.
Figure 11:
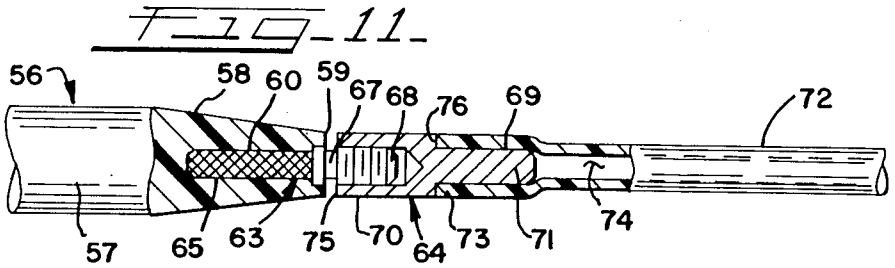
FIG. 11 is a plan view of the embodiment as shown in FIG. 10 wherein the first member is shown to be formed with the needle and the second, or female, member of the connector assembly is engaged at one side to a cable and at the other side is partially thread-engaged to the first member.
Figure 12:
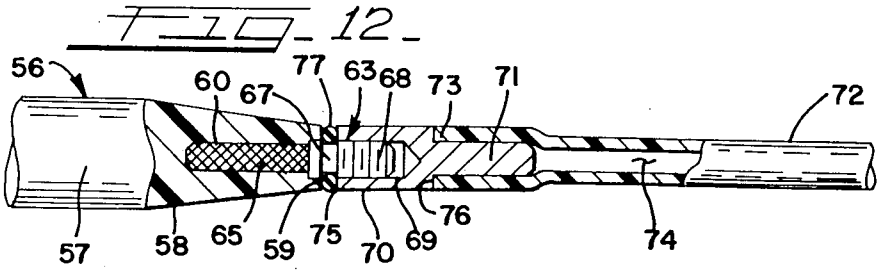
FIG. 12 is substantially the same as FIG. 11, but including a flexible O-ring arranged on an annnular shank of the first member between the base of the needle and second, or female, member.

A second form of the invention is shown in FIGS. 10 through 12. This form of the invention also eliminates the end connector breakage problems found in the prior art interchangeable knitting needle systems. However, instead of a direct engagement of an integrally molded plastic connector end at the needle base, and made of the same injection-molded material as the rest of the needle, the second form of the invention provides an insert, integral-like, molding of a pin end of one of a two-member metal coupler assembly with the end of the needle. The first insert-molded member is formed to be thread engageable at an opposite end to a second member at one end thereof. At an opposite end, the second member has a stem which is friction fitted inside the passage of a hollow flexible cable.

More specifically, the second form of the invention provides a knitting needle 56 having a manually held barrel portion 57, and bevelled or tapering, end 58, similar to the configurations for knitting needles A, B, C, and D of the first form of the invention. The tapering end 58 terminates in an end face 59 at a diameter less than that of the barrel 57 for substantially the same purposes as described with respect to the taper or bevel 12 of knitting needles A and B above. This form of the invention departs from the configuration for the knitting needles A, B, C, and D in that an end interface surface cavity 60 and, in preferred form, an annular recess 61, of slightly larger diameter than cavity 60, are formed axially adjacent to the face 59 by the integrally molding with a first member of a connector assembly 62. This first, or male coupling, member 62 is thread engageable with a detachable female connecting member 64 as will be hereinafter described. The male coupling member 63 includes a roughened axial pin end 65 which may be furrowed by knurling, or otherwise abraded, which is molded integrally with the needle 56 and thereby forms and defines the interface cavity 60 at the end of the needle. An annular collar 66 at the outward end of pin end 65 is provided in the preferred embodiment and forms the annular recess 61 at the end face 59 during the integral moldling process. The abrasions on the roughened pin end 65 cause the injection molded plastic, forming the needle 56, to seep around the indents and crevices to create a very tight bond therebetween upon cooling, whereby the male coupling member 63 is rigidly and permanently affixed to the needle 56 at the cavity interface 60 and the annular recess 61 formed by collar 66. The annular collar 66, in the preferred embodiment, is flush, or co-planar, with the exterior surface of face 59 of the needle 56.

As with needles A, B, C, and D, it is envisioned that the needle 56 comprise fairly rigid plastic, such as Type 6 nylon, ABS, or equivalent. In preferred form, the two-member coupling assembly 62 is comprised of brass which is well suited for metal-to-metal threaded interconnection. Axially spaced from the collar 66 and outward of the end face 59, is a recessed, smooth shank portion 67 of the male coupling member 63 which serves, during molding procedures, as a clamping surface for a tool holder means during the integral molding of needle of 56 with member 63. Thus, upon completing the molding, these joined elements may be removed therefrom by a holding tool, or other such device, gripping at the recessed shank 67. Further, the recessed shank 67 optionally serves the purpose of providing a flexible O-ring nesting surface, as will be discussed hereinafter. Extending axially therefrom, the male member 63 includes a threaded stem 68 for threaded engagment with the female connecting member 64.

The female connecting member 64 includes a threaded bore 69 axially bored within a generally exteriorly smooth barrel portion 70. The barrel portion 70 provides a diameter substantially the same as that of the end surface 59 of the needle 56. Thereby, upon thread engaging the female member 64 with the threaded stem 68, the length of the barrel 70 is of a length sufficient whereby to flushly abut against the surface 59 and form a smooth connection therebetween whereby knitted looped yarn may smoothly slide form the shaft 57 along the taper 58 and onto the exterior of the barrel 70 in a somewhat similar manner to that as provided by the sliding of looped yarn from the bevel 12 of needle of A onto the cable 14, as shown in FIG. 1.

In this form of the invention, unlike in the first form, there is no direct plastic-to-plastic connection between the needle 56 and the cable. The female connecting member 64 is provided with a roughened coupling stem portion 71 that extends axially from the opposite side of barrel 70 for frictional engagement within the passageway of a hollow, flexible cable generally referenced at numeral 72. Cable 72 is the same type as the cable 14 in FIG. 1, and preferably has an outside diameter of 0.125 inches which is flare-enlarged by the end engagement with the coupling stem 71 to be also about 0.150 inches and thereby likewise match the diameters of the barrel 70 and the end face 59 which, of course in the exemplary embodiment are correspondingly, sized to be about 0.150 inches in diameter. The cable 72 has a wall of a defined thickness shown at 73, and an interior passageway throughout generally referenced at 74 which is capable of receipt at opposite end, with threaded stems, 71 of female connecting members 64.

Thereby, in the second form of the invention, the prior art breakage problem is also eliminated at the end of the needle 56 inasmuch as the substantially integral casting, or bonding, of the pin end 65 of the male member 63 with interface cavity 60 of the needle 56 creates a solid elongate metal-to-plastic conformation that is strong and not susceptible to snapping or breaking. The thread engagement of the stem 68 within the threaded bore 69 of the female portion is, as would be clear, a very secure, but easily accomplished, engagement, particularly when brass is utilized for these machined elements.

In FIG. 11, for purposes of explanation a partial engagement of the assembly 62 is shown, wherein the female connecting member 64 is illustrated as being almost completely thread engaged with the threaded stem 68 of the male coupling member 63. The depth of the bore 69 is such that at full thread engagement an end face 75 of the barrel 70 will flatly abut against the end face 59 of the needle 56, as would be understood. The engagement of the roughened coupling stem 71 of the female connecting member 64 is shown engaged to the cable 72 and flaring the wall 73 at the end thereof, in a similar manner as explained with respect to the cable end flaring in the first form of the invention.

In the second, and in all forms, of the invention, a thicker cable, such as cable 22 in FIG. 7, may be provided to have an end bevel so that, for example, the smooth sliding transition of looped yarn to the cable from the female member 64, over its barrel portion 70, may be accomplished. Similarly, should a thin knitting needle configuration be required for needle 56, as shown in the smaller diameter version at needle C of FIG. 8, the taper 58 might not be required, since the diameter of the barrel 57 could be made to be substantially the same diameter as the flare-enlargened end of the cable 72, which in the preferred embodiment is stated to be about 0.150 inches. Correspondingly, in the illustrative example of the second form of the invention, an end face 76 of the barrel 70 of the female connecting member 64, at the side opposite the face 75, has a diameter of 0.150 inches whereby to match the flared, or enlarged, end of the cable 72 upon the insertion of the roughened coupling stem 71 with the cable 72. The friction-fitting of the roughened coupling stem 71 is preferably a rigid, tight, almost permanent-type, fitting, in contradistinction to the detachable engagement provided by the threading of the connector ends 13 of needles of A, B, connecting end 44 of needle C, or connecting end 52 of needle D, which are made to be thread-disengageable for accomplishing the interchangability feature in said first form of the invention. Interchangeability in the second form of the invention is provided by the unthreading of the female connecting member 64 from the male member 63 which allows the craftsperson quickly to detach a cable 72 associated with the female connector 64 and re-engage with one having a different length and engaged by a different female member 64. Thereby, a male coupling member 63, affixed to a needle 56, would be provided for engagement with different female members 64 at ends of different cables 72 to cooperatively form the connector assembly 62 upon each said engagement, as would be understood.

In FIG. 12, an alternative embodiment for the second form of the invention is provided wherein the connector assembly 62 includes a flexible O-ring 77 for nesting around the smooth shank 67 of the male coupler member 63. The inside diameter of the O-ring 77 is of a size whereby to closely fit around the smooth shank 67. The O-ring 77 is retained at one side by the collar 66 and at the other side by the larger-diameter threaded stem 68 whereby, upon the detachment of the female connecting member 64 from the male coupler 63, the O-ring 77 will not fall off.

The O-ring 77 provides various functions in enhancing the performance of the connector assembly 62. Firstly, any rough metal edges at the barrel 70 of the female member 64 are prevented from creating a snagging problem with yarn since the end face 75 will compress the O-ring 77 and force it to bulge outwardly to provide a smooth transition surface from the taper 58 onto the barrel 70. Secondly, a close tolerance threading, or machining, is not required for the engagement of the threaded stem 68 and bore 69 inasmuch as the O-ring, being of a flexible plastic material, supplies a little biasing compression force upon thread-tightening the female connecting member 64 onto the male coupling member 63, and it also thereby cinches up the connection therebetween. Thus, the male coupling member 63 and female connecting member 64 are not required to have close tolerance threading and the threaded bore 69 can be desirably provided to spin freely into engagement on the threaded stem 68. As a result, a more free, or loose, easily manipulated threading may be provided while still achieving a constant, secure connection by the spring-like biasing effect of the compressed O-ring 77 upon the thread engagement of the male and female members 63 and 64. Moreover, if there is a machining or molding mismatch, the O-ring 77 bulges when compressed and causes the mismatching of the diameters of face 59 and the diameter of surface 75 to be minimized. The initial outside diameter of the O-ring 77 is preferably provided to be slightly less than the diameter of face 59 and end face, or surface, 75 whereby upon thread engaging bore 69 with stem 68, the face 75 squeezes against the O-ring 77 to slightly bulge it and thereby approximate the 0.150 inch nominal diameters of the face 59 and barrel 70. Also, while there is usually not a significant problem with rough or sharp edges in casting a Type 6 nylon, ABS, or equivalent, used for the needle 56, any inadvertently formed burrs or sharp edges remaining from the molding process will likewise be compensated for by the bulging and compressing of the O-ring 77, as would be understand.

In preferred form, the O-ring 77 is shown to have a circular cross section. Alternately, it should be clear that the O-ring 77 might have a square, oval, rectangular, trapezoidal, or other geometric cross-sectional shape which also provides, or enhances, the smooth, tapered transition for looped yarn from the taper 58 onto the barrel 70.

Thus, the second form of the invention provides an effective metal-to-metal threaded engagement for the coupling assembly 62 by the male coupling member 63 thread engaging at the threaded stem 68 within the threaded bore 69 of the female connecting member 64. This metal-to-metal meeting of parts assures long thread life and eliminates some additional problems with cross threading that is often caused by plastic threaded members. By eliminating the use of a metal adaptor member for engaging the end tips of plastic needle shafts, as found in the prior art, the previously described breakage problem is eliminated in both forms of the invention. In the second form, the invention preferably utilizes two brass members 63 and 64 to form the coupling assembly 62, which assembly is well suited to known machine threading manufacturing techniques and will assure a very tight, easily thread engaged, and detached, interchangeable coupling function. With the use of the O-ring 77, the craftsperson is able to select the amount of tightness of the connection during the thread engaging of the members 63 and 64, to variably compress the bias the ring 77, as would be understood. Thus, more costly close machine tolerance for the threading need not be required, and a freer, more easily threaded, but firmly connected, arrangement may be provided.

For both forms of the invention, it would be understood that the utilization of the stop-buttons 27 and double-endeded-connectors 34, shown in FIGS. 2–4, may be utilized with the cable 72 in conjunction with utilization of connectors assemblies 62 at the ends of cooperative knitting needles 56. Thus, a hybrid of the first and second forms of the invention may be utilized. In this regard, for example, if two cables 72 were strung together, the double-ended connector 34 would be used therebetween. Likewise, if only a single length of cable 72 would be needed, and only one needle 56 were required at one end of the cable, the stop-button 27 may be connected at the needle-opposite end of the cable 72, as explained in the discussion of the first form of the invention.

Alternatively, double-ended connector and stop-button means may be formed to have substantially the same friction fitting coupling stems, such as the roughened stem 71, for insertion into a cable 72. Another alternative envisions utilizing the female connectors 64 at cable ends, for thread engagement to male threaded stem members formed to be stop buttons or double-ended connectors for engagement to said female portions at one, or opposite sides, respectively. For example, a double-ended connector might be formed when two opposite threaded stems 68 extend in opposite directions from a central collar portion like collar 66, similar to the arrangement of the double-ended connector 34 with central shaft 35 of FIG. 4. Futhermore, the central collar portion may be formed like the collar 66 of the male member 63 wherein a shank 67 and threaded stem 68 would extend from opposite sides, replacing the pin end 65, for engagement at said both sides with the threaded bore 69, of opposing female members 64 arranged at ends of the two cables to be joined, whereby to string the cables between needles 56, as possible using the double-ended connector 34. Additionally, the collar portion 66 may be enlarged in the form of a stop-button, circular disc-shape such as shown at stop-button 27, with the pin end 65 again replaced, for use at an end of a cable 72 which is engaged by a female member. Thus, with modification to collar 66 and replacement of the pin end 65, connector and stop button features may be provided which achieve the thread disengageable and interchangeable capabilities, and provide double-ended and connector stop button male members for thread engagement with female members 64 which may be attached at the ends of cables 72 as shown in FIGS. 10–12.

In the second form of the invention, the needle 56 has a diameter substantially the same as that shown from needles A and B of the first form of the invention. Clearly, C and D sized needles as shown in the first form may be provided to be integrally molded with the male coupling member 63 and form an interior interface cavity 60 and an annular collar 61, by the stem 65 and collar 66, respectively, in substantially the same molded formation shown for the needle 56 and the male coupling member 63 in FIG. 10.

In all forms of the invention, a wide variety of arrangements for the components may be achieved to facilitate the creation of innumerable knitted craft projects in which the breakage problem with cable connections to knitting needles is eliminated, wherein interchangability of components may be quickly and surely made so that smooth transition surfaces may be provided without snagging yarn, and wherein tight securement between needles and cables is provided while still providing for components that are easily detached when rearrangement of the system is desired.

What is claimed is:

1. An interchangeable knitting needle system comprising at least one knitting needle having a tip, a shaft extending therefrom and terminating at a tip-opposite base, said tip-opposite base associating with cable connector means, said connector means comprising a two-member coupling assembly including a coupling member having an insert pin end integrally formed with a needle shaft and extending inwardly from said base and an engageable threaded stem portion extending outwardly from the base, and a connecting member including a barrel portion having an axial threaded bore at one end thereof, the axial bore being thread-engabeable with the stem portion of the coupling member and extending from the opposite end of the barrel portion, said connecting member having a coupling stem means capable of engageable insertion at the end of a hollow flexible cable; and, at least one hollow flexible cable capable of receiving looped knitted material thereon upon the engagement at one end thereof with said coupling stem means of said connecting member, said cable connector means and flexible cable being capable of repetitive engagements and disengagements.

2. An interchangeable knitting needle system as claimed in claim 1, wherein said coupling member of the connector assembly further includes a collar portion having a larger dimension than said integrally formed insert pin end and arranged to be recessed at the bottom of the shaft generally flush with the base thereof.

3. An interchangeable knitting needle system as claimed in claim 2 wherein said coupling member includes, intermediate said collar portion and said threaded stem, an annular shank portion having a diameter less than said collar portion and said threaded stem.

4. An interchangeable knitting needle system as claimed in claim 1 wherein the coupling stem means of said connecting member of the connector assembly is cable-engageable by being friction fit interiorly at the end of said flexible cable.

5. An interchangeable knitting needle system as claimed in claim 4 wherein said coupling stem means flares the end of said flexible cable when engaged therewith.

6. An interchangeable knitting needle system as claimed in claim 5 wherein said barrel portion has a larger diameter than said coupling stem means, and wherein upon engagement of the coupling stem means with a flexible cable the diameter of the barrel portion substantially equals the diameter of the flared end of said engaged flexible cable.

7. An interchangeable knitting needle system as claimed in claim 1 wherein the barrel portion of the connecting member has an outside diameter substantially the same as the diameter of the base of said shaft.

8. An interchangeable knitting needle system as claimed in claim 1 wherein the shaft of the knitting needle is larger than the outside diameter of the barrel portion of the connecting member of the connector assembly, said shaft terminating adjacent said base in a tapered portion whereby the shaft diameter tapers to said base diameter wherein the base has a diameter substantially the same as the barrel portion of the connecting member.

9. An interchangeable knitting needle system as claimed in claim 1 wherein said knitting needle includes a shaft having a diameter substantially the same as the outside diameter of the barrel portion of the connecting member.

10. An interchangeable knitting needle system as claimed in claim 1 wherein said system includes a plurality of hollow flexible cables and at least one double-ended connector means capable of stringing a plurality of cables from a knittting needle.

11. An interchangeable knitting needle system as claimed in claim 1, wherein said system includes a stop button means engageable at an end of the flexible hollow cable.

12. An interchangeable knitting needle system as claimed in claim 1 wherein said coupling stem means extends axially from the opposite end of said barrel portion for engagement with the flexible cable and said coupling stem means has a smaller diameter than said barrel portion, and wherein said flexible cable has an inside diameter sized in relation to said coupling stem means whereby upon the inserted engagement of the coupling stem means at an end of the cable, the end is flared to have an outside diameter larger than the diameter of said barrel portion of the connecting member.

13. An interchangeable knitting needle system as claimed in claim 12 wherein said cable includes a circumferential bevel formed around the engaged end thereof whereby to taper the diameter of the flared end of the cable to substantially the same diameter as said barrel portion of the connector member.

14. An interchangeable knitting needle system as claimed in claim 1 wherein said coupling member includes a shank intermediate the the insert pin end and the threaded stem, said shank having a diameter less than the threaded stem.

15. An interchangeable knitting needle system as claimed in claim 14 wherein a flexible O-ring means is engaged around said shank and capable of being compressed against the base of the knitting needle by the barrel portion of the connecting member during the thread engagement of the connecting member with the threaded stem of the coupling member.

16. An interchangeable knitting needle system as claimed in claim 15 wherein the thread engagement between the threaded stem of the coupling member and the threaded axial bore of the connecting member is freely threadable wherein upon the compression of the barrel portion against the flexible O-ring means during said thread engagement with the threaded stem of the coupling member, the tightness of the thread engagement between said two members may be regulated by the user by changing the degree of compression against the flexible O-ring means whereby to cinch the connection to the tightness desired.

17. An interchangeable knitting needle system comprising a plurality of knitting needles, and at least one flexible hollow cable, said knitting needles including a tip, a shaft extending axially therefrom and said shaft terminating in a base portion, a two-member cable connecting assembly associating at the base of said shaft wherein the first member being a male coupler having an insert pin portion thereof formed with the shaft inwardly of said base portion and extending outwardly therefrom to terminate in a threaded axial stem, the second member being a female connector, said female connector having a threaded axial bore thread engageable with the threaded stem of said male coupler at one end thereof and axially extending at an opposite end thereof in a friction fitting coupling stem insertable within the interior of a flexible hollow cable whereby to be tightly engageable therewith, said male coupler and female connector being repetitively thread-engageable and thread-disengageable as selected by the user.

18. An interchangeable knitting needle system as claimed in claim 17 wherein at the base portion of said knitting needle shaft, said male coupler has a collar portion being larger in section than said pin portion and being arranged generally flush with the base portion of the shaft.

19. An interchangeable knitting needle system as claimed in claim 18 wherein intermediate said collar portion and said threaded stem said male coupler member has an annular shank being smaller in cross section than the threaded stem or collar portion.

20. An interchangeable knitting needle system as claimed in claim 19 wherein a flexible member is arranged around said annular shank whereby to be capable of being compressed against the base portion of the knitting needle shaft by said female connector during thread engagement of the male coupler with the female connector.

21. An interchangeable knitting needle system as claimed in claim 17 wherein said knitting needles are made of a molded plastic and wherein said cable connecting assembly is made of brass.

22. An interchangeable knitting needle system as claimed in claim 17 wherein said female connector has a barrel portion, said threaded axial bore being arranged within said barrel portion, and the diameter of the barrel portion being substantially the same as the diameter of the base portion of the knitting needle shaft.

23. In a knitting needle of the type associating with connector cable means capable of being engaged and disengaged with a hollow flexible cable, and having a tip, and a manually holdable shaft portion terminating at a tip-opposite base, the improvement comprising a two-member connector assembly for engagement with a flexible cable wherein the first member of the assembly being a male coupler member having a pin means fixably molded within the shaft of the needle and a portion extending outwardly of the base terminating in a threaded stem, said second member of the assembly being a female connector member having a first threaded bore portion thread engageable with the threaded stem of the male coupler member and at an opposite side thereof an axially extending coupling stem capable of frictional fitting within the end of a hollow flexible cable, wherein the connector assembly provides for the thread disengagement of the female connector member from the male coupler member, so that cable changes may be made without damage to the needle or cable, wherein the knitting needle is thereby capable of use in an interchangeable system.

24. The improvement as claimed in claim 23 wherein the knitting needle is an integrally molded plastic and the connector assembly is made of brass and the pin means of the male coupler member is provided with a roughened surface whereby during the molding thereof the plastic material forming the needle hardens around the roughened surface to create a rigid substantially permanent bond therebetween.

25. The improvement as claimed in claim 23 wherein the male coupler member includes a shank intermediate the base of the needle and the threaded stem, the shank having a smaller diameter said base and threaded stem, a flexible ring means around said shank whereby to be capable of being compressed by the female connector member against the needle base during the thread engagement of the threaded bore portion thereof by the threaded stem of said male coupler member, whereby the user may vary the thread engagement to vary the compression force on the flexible ring means as desired.

* * * * *